United States Patent [19]

Sahakian

[11] 4,126,254

[45] Nov. 21, 1978

[54] SKI CARRYING CASE

[76] Inventor: Albert D. Sahakian, 1814 N. Serrano Ave., Los Angeles, Calif. 90027

[21] Appl. No.: 765,853

[22] Filed: Feb. 4, 1977

[51] Int. Cl.[2] ..... A45C 7/00

[52] U.S. Cl. ..... 224/45 S; 206/593; 211/60 SK; 280/11.37 K

[58] Field of Search ..... 224/45 S, 45 R, 5 Z, 224/5 R; 280/11.37 K, 11.37 A, 11.37 R; 211/60 SK; 206/317, 591–593

[56] References Cited

U.S. PATENT DOCUMENTS

| | | | |
|---|---|---|---|
| 750,817 | 2/1904 | Crenshaw | 206/317 |
| 2,234,487 | 3/1941 | Davis | 211/60 SK |
| 3,248,027 | 4/1966 | Pflieder | 211/60 SK |
| 3,767,036 | 10/1973 | McLeod | 280/11.37 K X |
| 3,837,548 | 9/1974 | Nerger | 224/45 S |
| 3,921,871 | 11/1975 | Heil | 224/45 S |

FOREIGN PATENT DOCUMENTS

| | | | |
|---|---|---|---|
| 146,031 | 1/1936 | Switzerland | 280/11.37 K |

*Primary Examiner*—Albert J. Makay
*Assistant Examiner*—Donald W. Underwood
*Attorney, Agent, or Firm*—Huebner & Worrel

[57] ABSTRACT

A carrying case for skis and related equipment in which the case is formed of first and second members elongated with respect to the ski length and having a width adapted to receive a pair of skis juxtaposed with their bottoms on substantially the same supporting levels, the members being hinged along one side in the elongated direction so as to be pivotal into open and closed positions and having clamps along a side opposite said one side adapted to secure the members together in the closed position, holding devices associated with the first member to removably secure the skis juxtaposed in the first member, and supporting material in the first member to protectively support the ski bottoms at said levels.

1 Claim, 8 Drawing Figures

SKI CARRYING CASE

BACKGROUND OF THE INVENTION

Skis are easily damaged and need to be protected, particularly in transit when out of the personal supervision of the skier, as typically occurs in aircraft travel.

In the prior art there have been other ski containers in which the skis have not been adequately protected. In some of these containers the skis have been deformed for fitting purposes and held in a stressed condition.

SUMMARY OF THE INVENTION

The present invention is provided to protectively maintain the skis in a molded plastic non-bending high-strength-to-weight case in their natural shape without applying any stress.

Accordingly, it is an object of the invention to provide an improved ski carrying case.

It is another object of the invention to provide a container which supports skis so that their normal camber is maintained throughout their lengths.

It is still another object of the invention to provide a container adaptable to adequately support skis of different lengths.

It is a further object of the invention to provide a container, as described in the previous paragraphs, in which ski poles are easily secured and easily removed.

It is a still further object of the invention to provide a container for skis, as described in the preceding paragraphs, having a high-strength-to-weight ratio.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes.

DESCRIPTION OF THE PREFERRED EMBODIMENT

Figures 1, 5, 6, 7, 8:
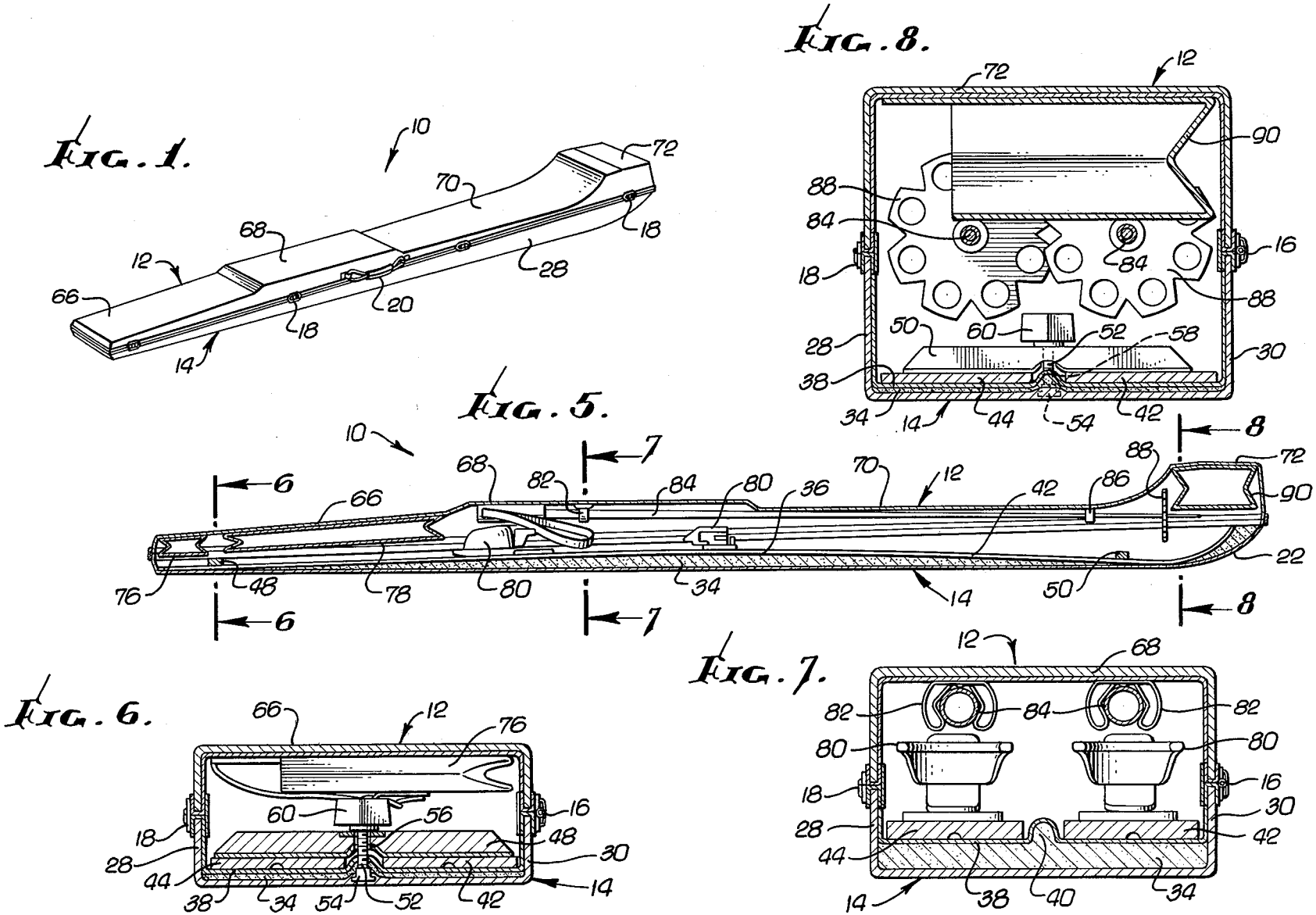
FIG. 1 is a perspective view of the exterior of the ski carrying case according to the invention.
FIG. 5 is a cross-sectional side view, taken along the lines 5—5 in FIG. 4.
FIG. 6 is a cross-sectional end view, taken along the lines 6—6 in FIG. 5.
FIG. 7 is a cross-sectional intermediate view of the case, taken along the lines 7—7 in FIG. 5.
FIG. 8 is a cross-sectional view at the forward end, taken along the lines 8—8 in FIG. 5.
Figure 2:
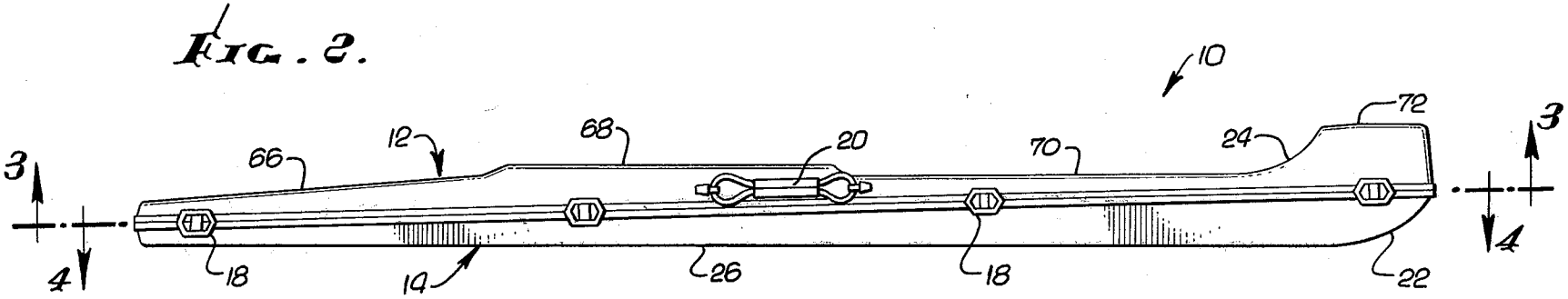
FIG. 2 is a side elevational view of the case shown in FIG. 1.
Figure 3:
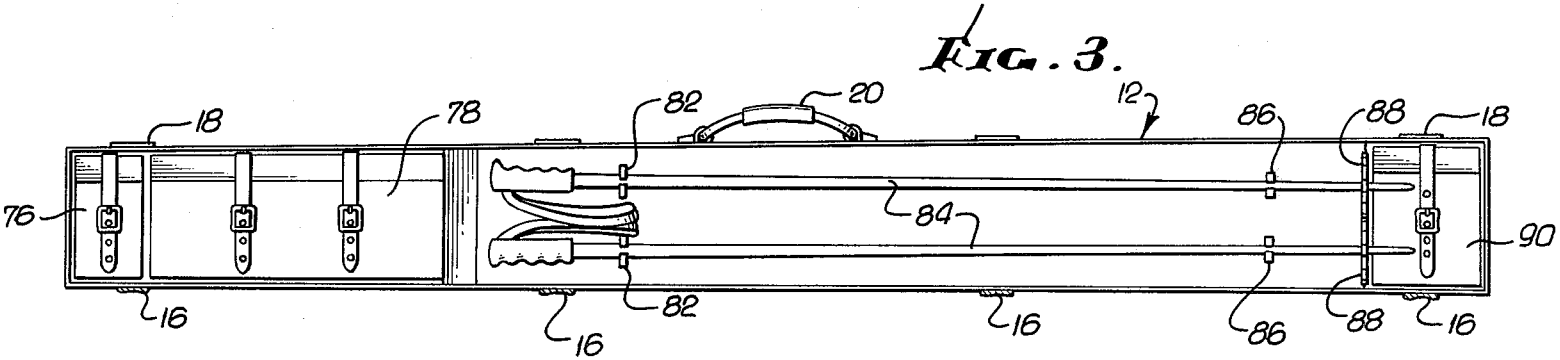
FIG. 3 is a plan view of the interior of the upper part of the case, taken along the lines 3—3 in FIG. 2.
Figure 4:
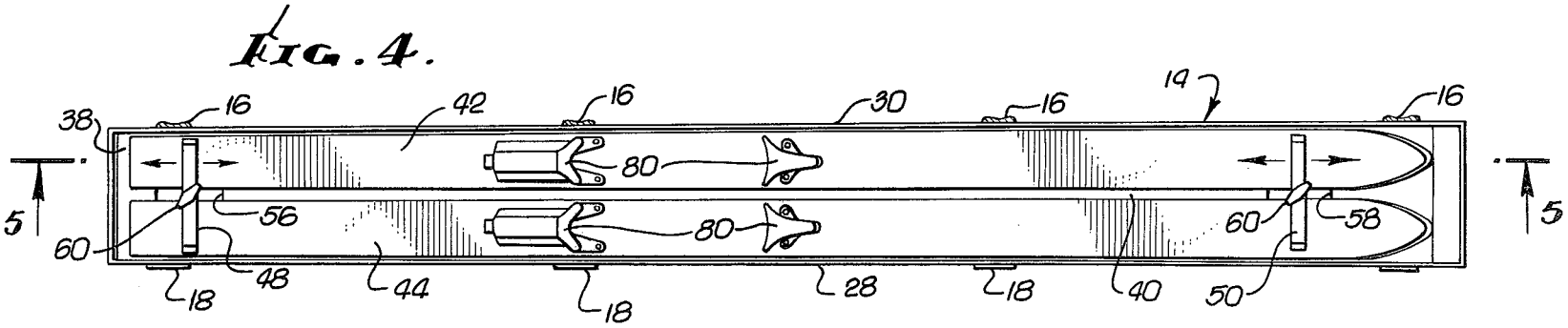
FIG. 4 is a plan view of the interior of the lower part of the case, taken along the lines 4—4 in FIG. 2.

Referring again to the drawings, a molded plastic carrying case, generally designated as 10, having a high-strength-to-weight ratio, is shown in its closed position in FIGS. 1 and 2. The case is formed of an upper member 12 and a lower member 14 hinged at 16 and as shown in FIGS. 6–8, the case being pivotal to open and close along the hinge. The hinge 16 may be of a single piano-type or may be comprised of a plurality of hinges, as shown in FIGS. 3 and 4. On the side opposite the hinges are a plurality of typical luggage closing clamps 18. The case is carried by a handle 20 secured centrally in the elongated direction to the upper member 12.

The case has generally flat external walls, except for the curves 22 and 24 at the forward end. The curve 22 is adapted to conform to the curves at the front end of the skis. Rearwardly of the curve 22, the lower member has an elongated flat bottom 26 from which upwardly extend flat side walls 28 and 30, terminating at parallel, rearwardly declining break lines along the hinges and clamps.

As shown in FIGS. 4–8, the inner bottom of the lower portion 14 has a layer of resilient material 34, such as polystyrene foam or some elastomeric material. The resilient material extends transversely across the inner bottom and for the full length of the skis in the elongated direction. As shown in FIG. 5, it has a convex upper surface 36 adapted to conform to the bottom surface of the skis and to support them for their full length in their natural position. Spaced between the resilient supporting material and the skis is a lining material 38, such as felt.

Extending centrally along the inner case bottom is an elongated ridge 40 formed of the resilient material and covered by the lining material. The ridge 40 is adapted to transversely space a pair of skis, as 42 and 44, in the case. The forward upwardly curved ends of the skis are supported and protected against breakage by a continuation of the material 34 secured inwardly at the front end of the ski at 22.

As best seen in FIGS. 4, 6 and 8, the skis are held in place by cross bars 48 and 50 at the forward and rear ends, respectively. The bars 48 and 50 are rotatable on bolts 52 which have non-rotatable nuts 54 fixed to their respective lower ends. The bolts extend upwardly through elongated slots 56 and 58 which extend in the ridge 40, the nuts 54 being secured in the case bottom. When loose, the bolts 52 are adapted to be moved forwardly or rearwardly in the slots 56 or 58 to be adjustably positioned according to the length of the skis. At the upper end of the bolts are hand tightenable heads 60.

The heads 60, like the bars 48 and 50, are rotatable to extend along the ridge 40 so that the skis can be inserted and removed. To secure the skis in place the bars are extended across the skis, as shown in FIG. 4, and the heads 60 are tightened on bolts so as to secure the bars and skis in place.

The upper case member 12 has a low upwardly inclining rear end 66, a raised intermediate portion 68, and a lowered forward portion 70 terminating in a high front end 72.

As shown in FIGS. 3 and 5–8, the interior of the member 12 is fitted in accordance with the exterior configuration. The rear end 66 has fitted multiple accordian pockets 76, 78 extending over the rear ends of the skis and when filled with clothing or the like form a cushion on the skis.

The intermediate portion 68 extends over the ski bindings 80 and has a pair of spaced, downwardly opening ski pole clamps 82, to receive the ski poles 84 adjacent their handles. A second pair of spaced pole clamps 86 are fitted in the forward portion 70. The pole baskets 88 extend adjacent the front end 72.

Forwardly of the baskets and above the pole ends, there is fitted in the high front 72 an accordian pocket 90 to carry additional equipment.

Thus, it is seen that the skis and poles are compactly and easily fitted and removed. The skis have no detrimental pressure thereon and are supported in their natural configuration by the resilient material 34.

The invention and its attendant advantages will be understood from the foregoing description and it will be apparent that various changes may be made in the form, construction and arrangement of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. A carrying case for skis and related equipment, comprising:

first and second molded plastic case forming members, having a high-strength-to-weight ratio, elongated with respect to ski length and having a width adapted to receive a pair of skis juxtaposed with their bottoms on substantially the same supporting levels, said members being hinged along one side in the elongated direction so as to be pivotal into open and closed positions, clamping means along a side opposite said one side adapted to secure said members together in the closed position, means in said first member to removably secure said skis juxtaposed therein, and being positioned to be adjacent each of the ends of the skis, said last means being adjustable horizontally along the ski lengths to accommodate for skis of different lengths, means in said first member to protectively support said ski bottoms at said levels, said means to support said ski bottoms being resilient material adapted to be substantially co-extensive with the ski lengths and widths, said material having an upper convex surface in the elongated direction complementary to the concave curve of the ski bottoms whereby the skis are supported in their normal configuration, said first member having a forward end to receive the forward curved upwardly extending ends of the skis, said material being positioned in said forward end to be under and forward of the forward ends of said skis to support and protect the ski ends, protective ridge means extending in the elongated direction adjacent the bottom of said first member to transversely space said skis when juxtaposed in said first member, said ridge means extending adjacent each of the ends of the skis and having slots therein for the horizontal adjustment of said means to removably secure said skis, said means to removably secure said skis including hand tightenable bolts extending upwardly from said slots, means on the lower ends of said bolts to retain them in said slots, holding bars on said bolts adapted to be rotated across said ski tops and tightened thereon by said bolts and being adapted, when loosened, to be rotated to extend on said ridge means to permit removal of said skis from said first member, said members having forward and rearward ends respective to the forward and rearward ends of the skis, said first member having generally flat walls and an upwardly curved front end, said second member having generally flat walls, a relatively low rearward end, a raised intermediate portion, and a high forward end, said high end and intermediate portion being spaced by a lower portion, said second member having space for and clamp means to secure a pair of ski poles therein, said ski poles being adapted to have their handles positioned in said intermediate portion and their other ends and baskets in said high forward end, said skis in the lower member having bindings spaced below said handles, equipment pockets being positioned in said rearward end adapted to extend over the rearward ends of the skis, and a pocket being positioned in said high forward end above the position of the pole forward ends and forwardly of the baskets, the pocket being adapted to be above the forward ends of the skis.

* * * * *